US006092508A

United States Patent [19]

Nakajima

[11] Patent Number: 6,092,508

[45] Date of Patent: Jul. 25, 2000

[54] AIR-FUEL RATIO CONTROLLER

[75] Inventor: Yuki Nakajima, Yokohama, Japan

[73] Assignee: Nissan Motor Co., Ltd., Yokohama, Japan

[21] Appl. No.: 09/022,041

[22] Filed: Feb. 11, 1998

[30] Foreign Application Priority Data

Feb. 12, 1997 [JP] Japan ..... 9-027860

[51] Int. Cl.[7] ..... F02M 7/00

[52] U.S. Cl. ..... 123/436; 123/492

[58] Field of Search ..... 123/436, 480, 123/492

[56] References Cited

U.S. PATENT DOCUMENTS

| | | | |
|---|---|---|---|
| 4,463,732 | 8/1984 | Isobe et al. | 123/492 |
| 4,527,529 | 7/1985 | Suzuki et al. | 123/478 |
| 4,667,631 | 5/1987 | Kinugasa | 123/325 |
| 4,694,807 | 9/1987 | Mori | 123/501 |
| 4,725,954 | 2/1988 | Takao et al. | 701/110 |
| 4,729,362 | 3/1988 | Mori | 123/492 |
| 4,753,362 | 6/1988 | Fujimoto et al. | 123/492 |
| 4,897,791 | 1/1990 | Sekozawa et al. | 701/106 |
| 4,984,552 | 1/1991 | Nishizawa et al. | 123/492 |
| 4,987,885 | 1/1991 | Fujita et al. | 123/492 |
| 5,014,672 | 5/1991 | Fuji et al. | 123/492 |
| 5,094,209 | 3/1992 | Kishida et al. | 123/422 |
| 5,255,655 | 10/1993 | Denz et al. | 123/479 |
| 5,271,374 | 12/1993 | Nagaishi et al. | 123/675 |
| 5,277,164 | 1/1994 | Takahashi et al. | 123/492 |
| 5,690,075 | 11/1997 | Tanaka et al. | 123/491 |

FOREIGN PATENT DOCUMENTS

| | | |
|---|---|---|
| 3-111639 | 5/1991 | Japan . |
| 7-6422 | 1/1995 | Japan . |

*Primary Examiner*—Henry C. Yuen
*Assistant Examiner*—Hai Huynh
*Attorney, Agent, or Firm*—Foley & Lardner

[57] ABSTRACT

A basic fuel injection amount is calculated according to an engine running state, and a fuel injection amount based on the basic fuel injection amount is injected by a fuel injector in synchronism with the engine rotation. An increase of an intake air amount is also estimated from when synchronous injection starts to when the engine intake stroke is complete. The fuel injector is controlled so that a fuel amount corresponding to this increase is asynchronously injected relative to the engine rotation. In this way, the fuel injection amount immediately increases when there is an increase of intake air amount during synchronous injection, and engine acceleration performance is improved.

12 Claims, 5 Drawing Sheets

AIR-FUEL RATIO CONTROLLER

FIELD OF THE INVENTION

This invention relates to air-fuel ratio control of an engine.

BACKGROUND OF THE INVENTION

In a four stroke cycle engine having a fuel injector in an intake port, fuel is injected for example in synchronism with the engine rotation.

This may be done for example by injecting fuel into the intake port in the exhaust stroke of a given cylinder, the injected fuel then being aspirated into the cylinder together with air in the next intake stroke.

The amount of injected fuel is controlled so that the air-fuel ratio of the air-fuel mixture entering the cylinder is a target air-fuel ratio. To perform this control, the engine air intake amount is measured by an air flow meter installed in an engine intake passage, and the fuel injection amount is determined according to the intake air amount. To maintain suitable engine combustion conditions, increase engine output and improve the exhaust composition, the air-fuel ratio of the air-fuel mixture which is burnt in the cylinder must be precisely controlled so that it coincides with the target air-fuel ratio.

The fuel amount is determined based on the latest intake air amount, and the intake air amount is determined at least a short time in advance of the fuel injection timing. Therefore, the measured intake air amount is not strictly identical to the intake air amount which is actually aspirated into the cylinder together with injected fuel.

In particular, under transient running conditions such as during engine acceleration or deceleration, the engine rotation speed varies and consequently, the intake air amount also largely varies. During acceleration, for example, the intake air amount aspirated into the cylinder together with injected fuel in the intake stroke is larger than the intake air amount measured prior to fuel injection, and the resulting air-fuel ratio is lean. If the injection amount is not increased in such a case, the engine combustion conditions will depart from the ideal, and the expected engine output will not be obtained.

Tokko Hei 7-6422 published by the Japanese Patent Office in 1995 concerning air-fuel ratio correction under transient conditions, predicts a change value of the intake air amount occurring from fuel injection to when the intake valve closes, and corrects the fuel injection amount based on this value.

The fuel injection period is generally determined as follows. First, an injection end timing is determined so that all of the injected fuel is aspirated into the cylinder in the next intake stroke and an injection start timing is determined so that injection of a predetermined fuel amount is completed at this timing. The injection end timing is set to, for example, 20 degrees prior to exhaust top dead center.

The fuel injection amount is directly proportional to the length of the fuel injection period, and the fuel injection period becomes long when a large fuel injection amount is required such as when the engine is at low temperature. As a result, the fuel injection start timing is earlier, and the interval from the injection start timing to when the intake air valve closes increases. During this interval, injection of the determined injection amount has already started, so even if the intake air amount increases during this interval, the amount of injected fuel on this occasion cannot be adjusted to cope with this increase. This is because the injection end timing is determined as described hereabove, and the injection period cannot be modified once injection has started.

This situation is identical to prior art devices wherein the change of intake air amount is predicted to increase the fuel injection amount, e.g., when variation of the intake air amount is different from the predicted amount, correction of the fuel injection amount cannot be made until the next fuel injection.

Hence even if the air amount and fuel amount actually aspirated into the cylinder do not correspond, some time is required until a correction can be made, and during this time the air-fuel ratio is lean. This causes a decline in engine acceleration performance.

SUMMARY OF THE INVENTION

It is therefore an object of this invention to enhance the response characteristics of fuel injection control relative to the variation of the intake air amount.

In order to achieve the above object, this invention provides an engine air-fuel ratio controller, comprising a fuel injector for injecting fuel, a sensor for detecting an engine running state, and a microprocessor.

The microprocessor is programmed to calculate a basic fuel injection amount according to the engine running state, control the fuel injector to perform a synchronous injection in which a fuel injection amount based on the basic fuel injection amount is injected by the fuel injector in synchronism with the engine rotation, estimate an intake air amount increase during a period from a start of the synchronous injection to when an engine intake stroke is complete, and control the fuel injector to perform an asynchronous injection in which a fuel amount corresponding to the increase is asynchronously injected with respect to the engine rotation.

When the engine comprises an air intake valve, it is preferable that the microprocessor is further programmed to set a timing when the engine intake stroke is complete to a predetermined angle before the intake valve closes.

It is also preferable that the microprocessor is further programmed to calculate a variation amount of the basic fuel injection amount within a predetermined time, and estimates the increase from the variation amount, the predetermined time, and the period.

It is further preferable that the microprocessor is further programmed to prohibit further asynchronous injection at the earlier of two times, these times being when the asynchronous injection is complete and when the intake stroke is complete.

It is also preferable that the microprocessor is further programmed to prohibit further asynchronous injection when the variation amount is negative after an asynchronous injection is performed.

It is also preferable that the microprocessor is further programmed not to perform asynchronous injection when the increase is less than a predetermined value.

It is also preferable that the sensor comprises a crank angle sensor for detecting an engine rotation position and an air flow meter for detecting an engine intake air amount.

It is further preferable that the microprocessor is further programmed to calculate the basic fuel injection amount such that the basic fuel injection amount is in inverse proportion to the engine rotation speed and in direct proportion to the intake air amount, and to calculate the increase of the intake air amount from the increase of the basic fuel injection amount.

This invention also provides an engine air-fuel ratio controller, comprising a fuel injector for injecting fuel, a mechanism for detecting an engine running state, a mechanism for calculating a basic fuel injection amount according to the engine running state, a mechanism for controlling the fuel injector to perform a synchronous injection in which a fuel injection amount is injected by the fuel injector in synchronism with the engine rotation based on the basic fuel injection amount, a mechanism for determining whether or not the engine is in an acceleration state, a mechanism for estimating an intake air amount increase from the start of a start of the synchronous injection to when the engine intake stroke is complete when the engine is in an acceleration state, and a mechanism for controlling the fuel injector to perform an asynchronous injection in which a fuel amount corresponding to the increase is asynchronously injected with respect to the engine rotation.

The details as well as other features and advantages of this invention are set forth in the remainder of the specification and are shown in the accompanying drawings.

DESCRIPTION OF THE PREFERRED EMBODIMENTS

Figure 1:
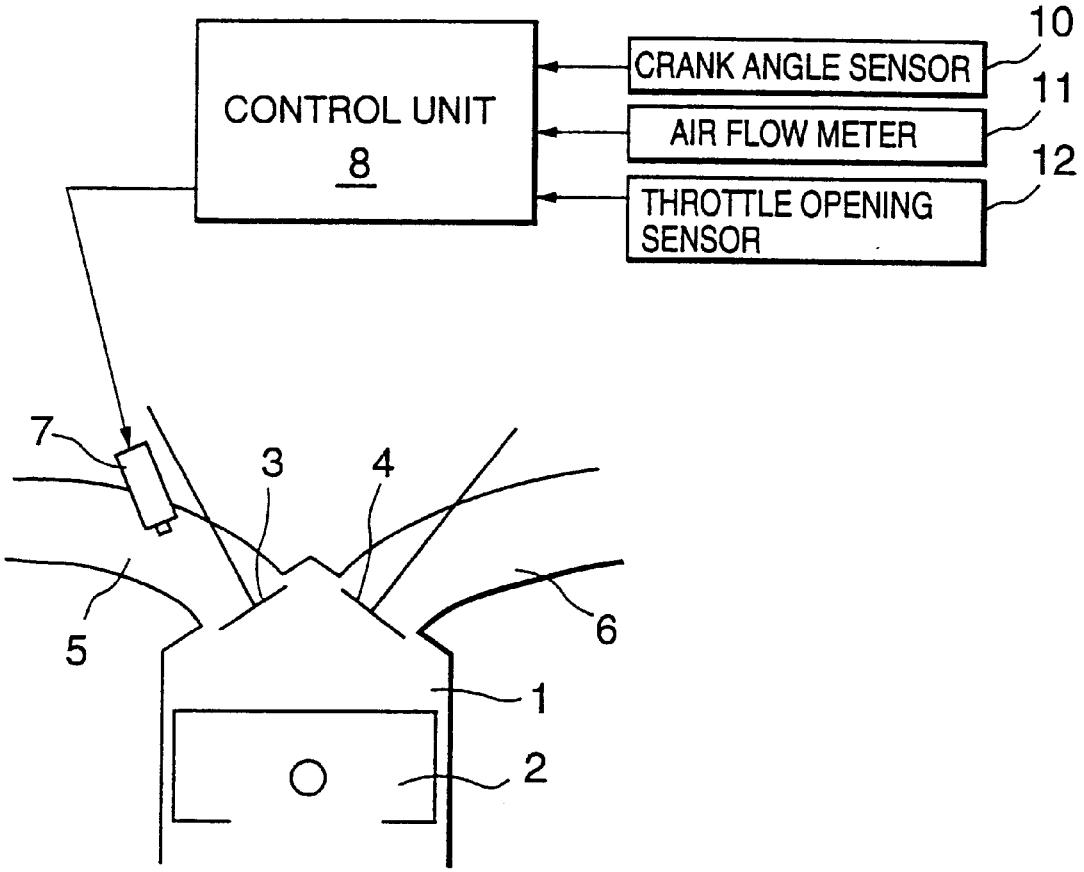
FIG. 1 is a schematic diagram of an air-fuel ratio controller according to this invention.

Referring to FIG. 1 of the drawings, a piston 2 is housed in an engine cylinder 1. The piston 2 performs a reciprocating motion between top dead center (TDC) and bottom dead center (BDC) according to combustion of the fuel-air mixture in a combustion chamber.

This engine is a six cylinder, four stroke cycle engine, wherein combustion takes place once in each cylinder for every two engine rotations.

The engine comprises an intake port 5 and exhaust port 6 adjacent to each cylinder 1.

An intake valve 3 is provided in the intake port 5, and an exhaust valve 4 is provided in the exhaust port 6. A fuel injector 7 for injecting fuel is also provided in the intake port 5.

The fuel injector 7 responds to an injection signal from a control unit 8. In principle, fuel is injected in synchronism with the engine rotation, however asynchronous injection is also performed wherein fuel is injected under transient running conditions as necessary regardless of the engine rotation position.

To enable the control unit 8 to perform fuel injection control, signals are input to the control unit 8 from a crank angle sensor 10, an air flow meter 11 for detecting the engine intake air amount, and a throttle opening sensor 12 for detecting the opening of a throttle, not shown, which increases or decreases the intake air amount. The crank angle sensor 10 outputs a Ref signal each time the engine rotates 120 degrees in conjunction with a specific step in each cylinder and outputs a Pos signal each time the engine rotates one degree.

Based on these input signals, the control unit 8 controls synchronous injection by the fuel injector 7 for each cylinder. This synchronous injection is known from, for example, U.S. Pat. No. 5,271,374.

In synchronous injection control, the control unit 8 sets an injection end timing at, for example, twenty degrees before TDC (20° BTDC) in the exhaust stroke of each cylinder.

The fuel injection start timing is calculated from a fuel injection period corresponding to the calculated fuel injection amount and the fuel injection end timing. Fuel injection from the fuel injector 7 is started according to this start timing, and continues for the above-mentioned fuel injection period.

The reason why the fuel injection end timing is fixed is in order to aspirate the whole of the fuel injection amount into the cylinder 1 in the next intake stroke.

Figures 5A, 5B, 5C, 5D, 5E:
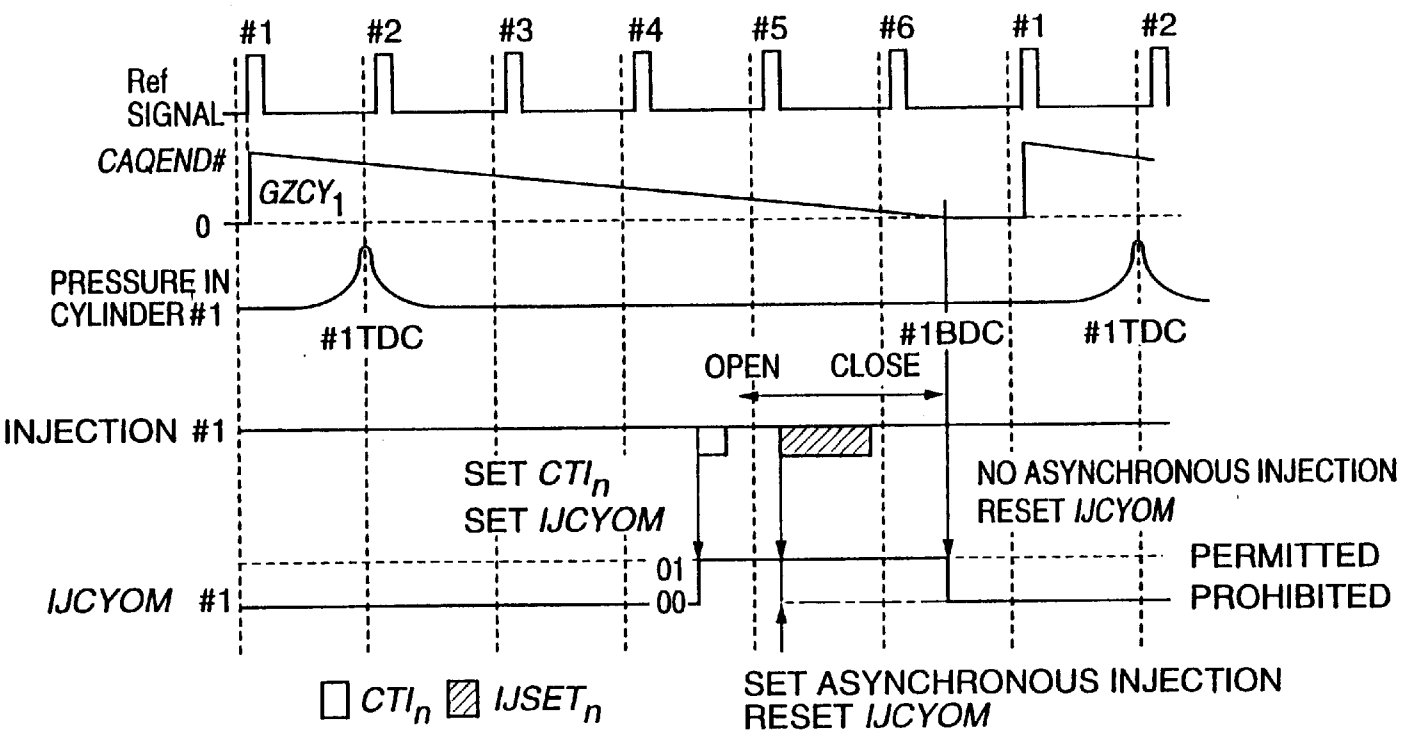
FIGS. 5A–5E are timing charts for describing examples of synchronous injection and asynchronous injection in a specific cylinder performed by the air-fuel ratio controller.

The control unit 8 predicts a change in the intake air amount during this interval, and performs asynchronous injection according to the cylinder as necessary during acceleration. This asynchronous injection is performed in the intake stroke after synchronous injection as shown in FIG. 5D.

This asynchronous injection during acceleration will be described referring to the flowcharts of FIGS. 2 and 3.

Figure 2:
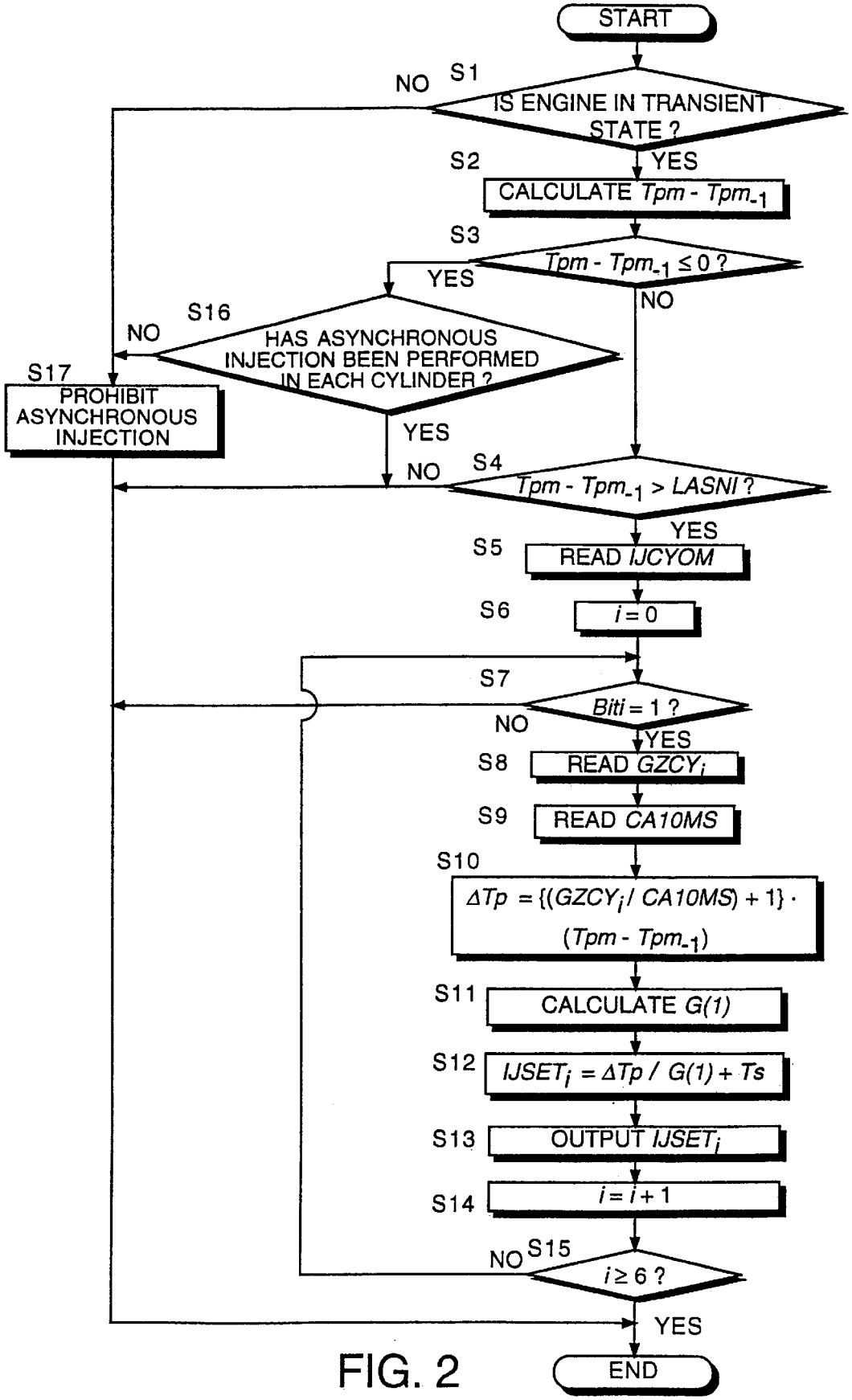
FIG. 2 is a flowchart for describing an asynchronous injection control process performed by the air-fuel ratio controller.
Figure 3:
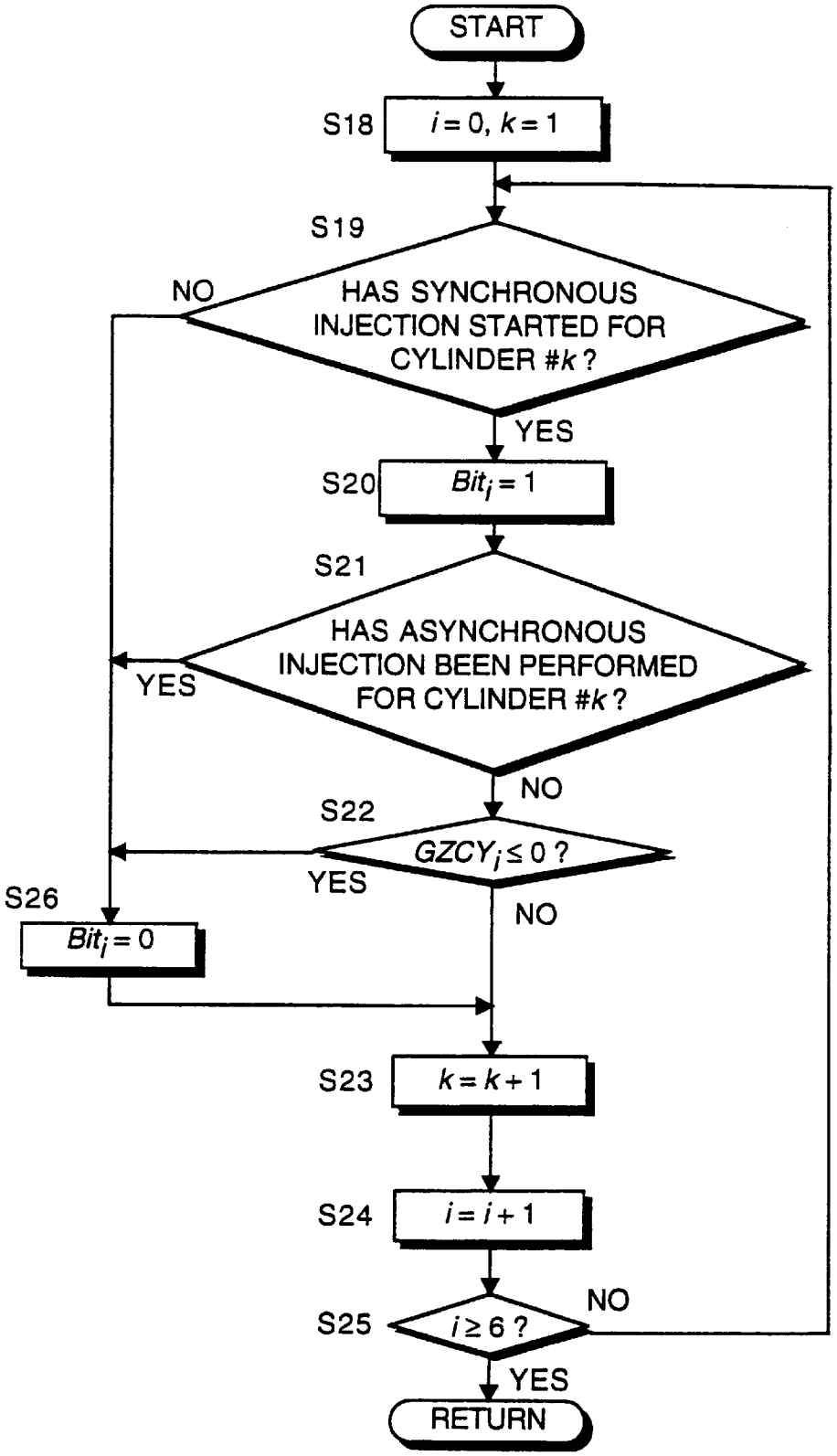
FIG. 3 is a flowchart for describing a process for calculating an asynchronous injection permission flag IJCYOM performed by the air-fuel ratio controller.

The processes shown in FIGS. 2 and 3 are performed, for example, every 10 milliseconds.

First, in a step S1 of FIG. 3, it is determined whether or not the engine is in a predetermined acceleration condition. This determination is performed by determining whether a change ΔTVO of a signal input from the throttle opening sensor 12 or a change ΔQHO input from the air flow meter 11 has exceeded a predetermined value.

When it is determined in the step S1 that the vehicle is not in a predetermined acceleration state, asynchronous injection of fuel is prohibited in a step S17, and the routine is terminated.

When it is determined in the step S1 that the vehicle is in a predetermined acceleration state, a variation in a basic injection fuel amount Tp is computed from the immediately preceding process to the present process in a step S2. A variation amount in 10 milliseconds, which is the process execution interval, is thereby estimated. The basic injection fuel amount Tp is known from the above-mentioned U.S. Pat. No. 5,271,374.

When the basic injection fuel amount on the present occasion is Tpm and the basic fuel injection amount obtained on the immediately preceding occasion is $Tpm_{-1}$, $Tpm-Tpm_{-1}$ is calculated in the step S2.

In a step S3, it is determined whether or not the variation amount $Tpm-Tpm_{-1} \leqq 0$. When $Tpm-Tpm_{-1}$ is positive, i.e. when the basic fuel injection amount is greater on the present occasion than on the immediately preceding occasion, it is determined in a step S4 whether or not the variation amount $Tpm-Tpm_{-1}$ is equal to or greater than a predetermined value LASNI.

It is thereby determined whether or not the vehicle is in an acceleration state which requires asynchronous injection.

When the variation amount $Tpm-Tpm_{-1}$ is equal to or greater than the predetermined value LASNI asynchronous injection is performed by the procedure of a step S5 or subsequent steps.

When $Tpm-Tpm_{-1}$ is less than the predetermined value LASNI in the determination of the step S4, the process is terminated without performing asynchronous injection.

In the step S5, a cylinder-specific asynchronous injection permission flag is read. A flag IJCYOM is calculated in a process shown in FIG. 3. Before describing processing of a step S6 and subsequent steps, the process of calculating this flag IJCYOM will be described with reference to FIG. 3.

First, a cylinder-specific asynchronous injection permission flag $Bit_i=0$ and a cylinder number k=1 are set in a step S18.

i=0 corresponds to cylinder no. #1, i=1 corresponds to cylinder no. #2, i=3 corresponds to cylinder no. #4, i=4 corresponds to cylinder no. #5, and i=5 corresponds to cylinder no. #6.

In a step S19, it is determined whether or not synchronous injection was started for cylinder #k. This embodiment applies to a six cylinder engine. When synchronous injection has not started, $Bit_i$ is reset to 0 in a step S26. $Bit_i=0$ denotes the prohibition of asynchronous injection.

In other words, asynchronous injection is permitted only after synchronous injection is performed.

When synchronous injection has started, $Bit_i=1$ is set in a step S20. $Bit_i$ is a cylinder-specific asynchronous injection permission flag, and the asynchronous injection permission flag IJCYOM is a general name for $Bit_i$. $Bit_i=1$ means that asynchronous injection is permitted.

In a step S21, it is determined that asynchronous injection was performed for cylinder #k.

When asynchronous injection has not yet been performed, it is determined in a step S22 whether or not an output value $GZCY_i$ of a cylinder-specific angle counter described hereafter, signifying the end of an intake stroke or the closing of the intake valve 3, is equal to or greater than 0.

When $GZCY_i$ is equal to or greater than 0, it signifies that the intake stroke is finished. In this case, asynchronous injection is prohibited by setting $Bit_i=0$ in the step S26.

Hence, when asynchronous injection has already been performed, or when the intake valve 3 is already closed, asynchronous injection is not performed.

When the cylinder-specific angle counter $GZCY_i>0$, the routine proceeds to a step S23, the cylinder number k is set to k+1, and i is set to i+1 in a step S24.

In a step S25, it is determined whether or not $i \geqq 6$, i.e. whether calculation of the asynchronous injection permission flag has been performed for all six cylinders of the engine. The asynchronous injection permission flag $Bit_i$ is then calculated by repeating the above process until $i \geqq 6$.

Returning now to the process of FIG. 3, these asynchronous injection permission flags $Bit_i$ are read in the step S5 of FIG. 3. As mentioned earlier, the asynchronous injection permission flag IJCYOM shown in the figure is the general name for $Bit_i$.

In a step S6, i is set to 0, and in the processing of a step S7 and subsequent steps, an asynchronous injection amount is computed for each cylinder. First, in the step S7, it is determined whether or not $Bit_0=1$, i.e. it is determined whether asynchronous injection is permitted for the cylinder #1. When $Bit_0=1$, the cylinder-specific angle counter $GZCY_i$ when asynchronous computation is read in a step S8.

The cylinder-specific angle counter $GZCY_i$ takes an initial value at a crank angle position after the intake stroke is finished, then begins to decrease according to the change of the rotation position of the engine, and reaches 0 at a timing when the intake valve 3 closes or at a predetermined angle before this timing.

As shown in FIG. 5B, the angle counter $GZCY_1$ for cylinder #1 is set so that it takes an initial value CAQEND at a time when a Ref signal corresponding to this cylinder is input to the control unit 8, and reaches 0 at bottom dead center (BDC) when the intake stroke is completed. Meanwhile, it decreases at a constant rate together with the engine rotation position.

Therefore, the value $GZCY_1$ of the angle counter read in the step S8 represents the remaining rotation angle from this timing to when the intake stroke is completed, in degree units.

The aforementioned characteristics of the cylinder-specific angle counter $GZCY_1$ are identical for the cylinder-specific angle counters $GZCY_1$ for all the cylinders.

If the acceleration of the engine is constant, the change of intake air amount is greater the lower the engine rotation speed. When engine rotation speed is low, intake is effectively completed at a timing earlier than the timing when the intake valve 3 actually closes, because the closing timing of the intake valve 3 is generally set later than the bottom dead center.

Hence, by setting the timing when the cylinder-specific angle counter $GZCY_i$ becomes 0 to a predetermined angle in advance of the timing at which the intake valve 3 closes, the estimate of intake amount described hereafter can be made to correspond more closely to reality.

In a step S9, an angle conversion value CA10MS is read signifying an engine rotation angle in each process execution interval, i.e. 10 milliseconds. This is calculated from the engine rotation speed obtained from the output signal of the crank angle sensor 10. For example, when the engine rotation speed is 1200 rpm the angle conversion value CA10MS is 72°.

In a step S10, a fuel injection increase amount ΔTp corresponding to an increased intake amount during the period from when synchronous injection starts to when the intake stroke is finished, is calculated by the following equation.

$$\Delta Tp=\{(GZCY_i/CA10MS)+1\}\cdot(Tpm-Tpm_{-1})$$

FIGS. 4A–4E show a method for predicting the increase ΔTp of the intake amount when the intake amount increases until the intake valve 3 is closed after synchronous injection was started.

Specifically, at the stage when asynchronous injection was permitted, the increase of the basic fuel injection amount from when the process was executed on the immediately preceding occasion is $Tpm-Tpm_{-1}$, and this corresponds to the angle conversion value CA10MS. Therefore, the increase of the intake amount until the intake valve 3 closes after synchronous injection starts, may be found from the aforesaid equation.

Figures 4A, 4B, 4C, 4D, 4E:
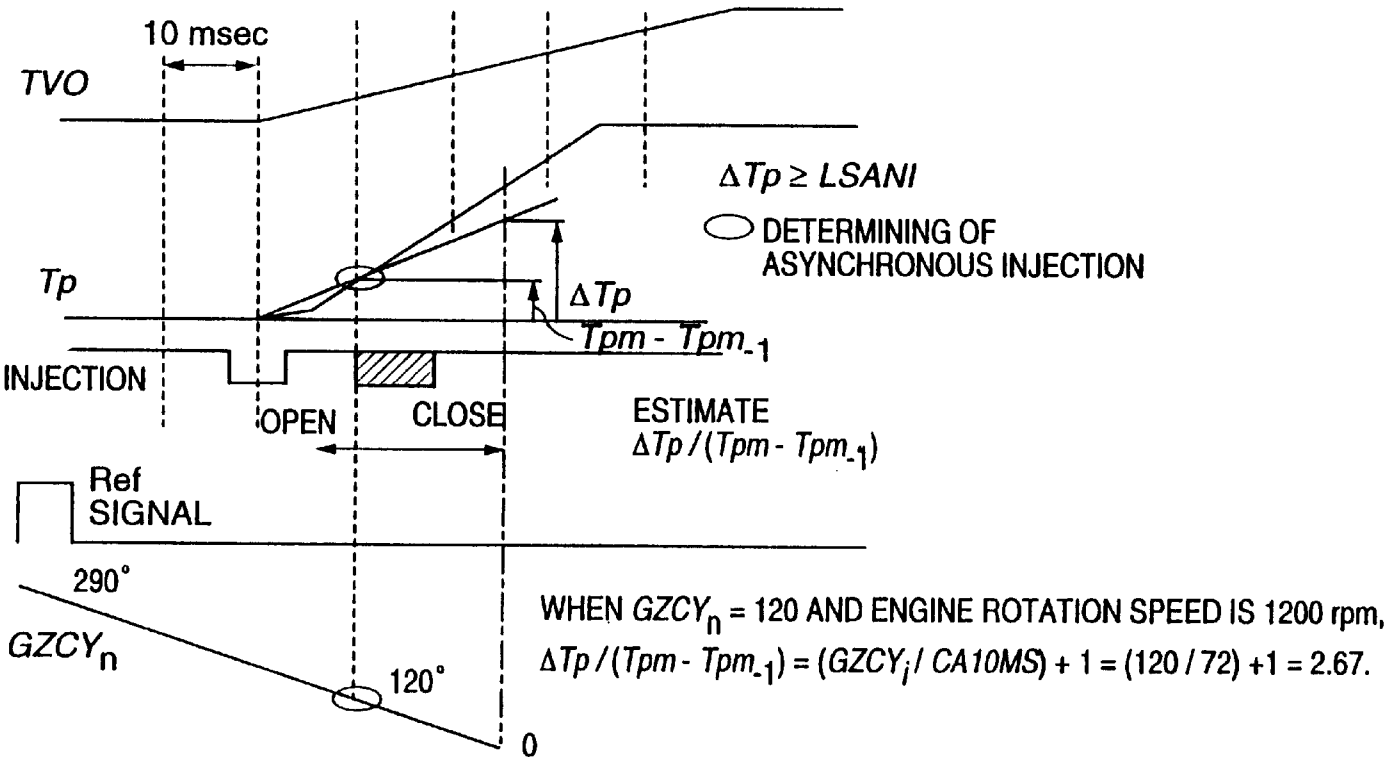
FIGS. 4A–4E are timing charts for describing an algorithm for estimating an intake air amount increase according to the air-fuel ratio controller.

For example, as shown in FIGS. 4B and 4E, when the angle counter $GZCY_i$ is 120° at a point when asynchronous injection was permitted and the increase rate of the basic fuel injection amount is constant, the counter is 0, i.e., the increase of the intake amount is 120/72=1.67 times until the intake valve 3 closes. However, as 10 milliseconds which is equivalent to the process execution interval elapses until asynchronous injection is permitted, the increase of the intake amount becomes 1+1.67=2.67 times.

Therefore, by multiplying this factor by $(Tpm-Tpm_{-1})$ which is the increase of the basic fuel injection amount in each process execution interval, the fuel increase amount ΔTp corresponding to the intake air increase amount from synchronous injection to the end of the intake stroke, can be calculated.

In a step S11, a fuel response parameter is calculated. Even when the air intake increase amount is identical, the increase amount of the injected fuel should vary according to the response of the injected fuel.

If the response is slow, this must be foreseen and more fuel must be injected beforehand, conversely when the response is fast, a smaller fuel amount may be injected beforehand.

Herein, fuel response refers to the time needed for fuel to flow into a cylinder after injection.

The flow of injected fuel comprises a high frequency component with a high response, and a low frequency component with a low response. This characteristic is expressed by a response parameter G(1). The response parameter is known for example from Tokkai Hei 3-111639 published by the Japanese Patent Office in 1991.

In a step S12, an asynchronous injection amount IJSET is calculated by the following equation.

$$IIJSET_i = \Delta Tp/G(\mathbf{1}) + Ts$$

where, Ts=ineffectual fuel injection pulse width.

In a step S13, the asynchronous injection amount $IJSET_i$ is output, and asynchronous injection is performed for the cylinder #1.

Next, in a step S14, i is set to be i+1, and in a step S15 the value of i is compared with the predetermined number 6, which is identical to the number of cylinders of this engine.

If i<6 in the step S15, the process from the step S7 to the step S15 is repeated for the other cylinders until i>6.

When the intake air amount variation is negative in the aforesaid step S3, it is determined in a step S16 whether or not at least one asynchronous injection has been performed in each cylinder.

When at least one asynchronous injection has been performed in each cylinder and the intake air amount variation is negative, it is assumed that the acceleration state has ended, and the process is terminated.

On the other hand, when the intake air amount is negative although asynchronous injection has not yet been performed in at least one cylinder, asynchronous injection is prohibited in all cylinders and the process is terminated in a step S17.

In this air-fuel ratio controller, when it is determined that the engine is in an acceleration state, the increase of the intake air amount is detected from the variation of the fuel injection amount in unit time, and when this increase is equal to or greater than a predetermined value, asynchronous injection is performed after synchronous injection of fuel.

To compute this asynchronous injection amount, the increase of the intake air amount from ordinary synchronous fuel injection which is performed in the engine exhaust stroke to when the intake valve closes, is estimated, and the asynchronous injection amount is computed based on this estimated value.

As asynchronous injection is performed immediately after synchronous injection, the fuel amount can be increased corresponding to the intake air amount after synchronous injection until the intake stroke is complete even when the engine is accelerating. Therefore, according to this air-fuel ratio controller, the fuel amount can be increased corresponding to the intake air amount actually aspirated by the cylinder.

This prevents overlean, which tends to occur in the early stages of acceleration, and good acceleration performance can therefore be obtained.

The corresponding structures, materials, acts, and equivalents of all means plus function elements in the claims below are intended to include any structure, material, or acts for performing the functions in combination with other claimed elements as specifically claimed.

The embodiments of this invention in which an exclusive property or privilege is claimed are defined as follows:

1. An engine air-fuel ratio controller, comprising:

a fuel injector for injecting fuel;

a sensor for detecting an engine running state;

a microprocessor programmed to:

calculate a basic fuel injection amount according to the engine running state;

control said fuel injector to perform a synchronous injection in which a fuel injection amount based on said basic fuel injection amount is injected by said fuel injector in synchronism with rotation of the engine;

estimate an intake air amount increase during a period from a start of said synchronous injection to when an engine intake stroke is complete;

control said fuel injector to perform an asynchronous injection in which a fuel amount corresponding to said increase is asynchronously injected with respect to the rotation of the engine and is injected when the engine running state is at a predetermined acceleration condition during the engine intake stroke;

calculate a variation amount of said basic fuel injection amount within a predetermined time, and estimate said increase from said variation amount, said predetermined time, and said period; and prohibit further asynchronous injection at the earlier of two times, these times being when said asynchronous injection is complete and when the engine intake stroke is complete.

2. An engine air-fuel ratio controller, comprising:

a fuel injector for injecting fuel;

a sensor for detecting an engine running state;

a microprocessor programmed to:

calculate a basic fuel injection amount according to the engine running state;

control said fuel injector to perform a synchronous injection in which a fuel injection amount based on said basic fuel injection amount is injected by said fuel injector in synchronism with rotation of the engine;

estimate an intake air amount increase during a period from a start of said synchronous injection to when an engine intake stroke is complete;

control said fuel injector to perform an asynchronous injection in which a fuel amount corresponding to said increase is asynchronously injected with respect to the rotation of the engine and is injected when the engine running state is at a predetermined acceleration condition during the engine intake stroke; and prohibit further asynchronous injection when said variation amount is negative after an asynchronous injection is performed.

3. An engine air-fuel ratio controller, comprising:

a fuel injector for injecting fuel;

a sensor for detecting an engine running state; and a microprocessor programmed to:

calculate a basic fuel injection amount according to the engine running state;

control said fuel injector to perform a synchronous injection in which a fuel injection amount is injected by said fuel injector in synchronism with rotation of the engine;

read an engine rotation angle in a predetermined time;

detect an increase amount of said basic fuel injection amount corresponding to said engine rotation angle;

calculate an increase amount of said basic fuel injection amount from when synchronous injection starts to when the intake stroke is finished based on said engine rotation angle from when synchronous injection starts to when the intake stroke is finished, and said engine rotation angle in said predetermined time and said increase amount of said basic fuel injection amount corresponding to said engine rotation angle; and control said fuel injector to perform an asynchronous injection in which a fuel amount corresponding to said increase is asynchronously injected with respect to rotation of the engine and is injected when the engine running state is at a predetermined acceleration condition during the engine intake stroke.

4. An engine air-fuel ratio controller as defined in claim 3, wherein said microprocessor is further programmed to prohibit further asynchronous injection at the earlier of two times, these times being when said asynchronous injection is complete and when the engine intake stroke is complete.

5. An engine air-fuel ratio controller as defined in claim 3, wherein said microprocessor is further programmed to prohibit further asynchronous injection when said variation amount is negative after an asynchronous injection is performed.

6. An engine air-fuel ratio controller as defined in claim 3, wherein said microprocessor is further programmed not to perform asynchronous injection when said increase is less than a predetermined value.

7. An engine air-fuel ratio controller as defined in claim 3, wherein said sensor comprises a crank angle sensor for detecting an engine rotation position and an air flow meter for detecting an engine intake air amount.

8. An engine air-fuel ratio controller as defined in claim 3, wherein said microprocessor is further programmed to calculate said basic fuel injection amount such that said basic fuel injection amount is in inverse proportion to the engine rotation speed and in direct proportion to said intake air amount, and to calculate the increase of the intake air amount from said increase of said basic fuel injection amount.

9. An engine air-fuel ratio controller as defined in claim 3, wherein the asynchronous injection is performed when it is sensed that a difference between said basic fuel injection amount $T_{pm-1}$ at an immediately preceding synchronous injection time and said basic fuel injection amount $T_{pm}$ at a current synchronous injection time is a positive value that is greater than a threshold value LASNI.

10. An engine air-fuel ratio controller as defined in claim 3, wherein the increase of intake amount until asynchronous injection is permitted is calculated from said predetermined time and the increase of fuel injection amount during said predetermined time, and the increase of intake amount from asynchronous injection is permitted until an intake valve is closed is calculated from the ratio of an engine rotation angle to said predetermined time.

11. An engine air-fuel ratio controller, comprising:

a fuel injector for injecting fuel;

means for detecting an engine running state;

means for calculating a basic fuel injection amount according to the engine running state;

means for controlling said fuel injector to perform a synchronous injection in which a fuel injection amount is injected by said fuel injector in synchronism with rotation of the engine;

means for determining whether or not the engine is in an acceleration state;

means for reading an engine rotation angle in a predetermined time;

means for detecting an increase amount of said basic fuel injection amount corresponding to said engine rotation angle;

means for calculating an increase amount of said basic fuel injection amount from when synchronous injection starts to when the intake stroke is finished based on said engine rotation angle in said predetermined time and said increase amount of said basic fuel injection amount corresponding to said engine rotation angle; and means for controlling said fuel injector to perform an asynchronous injection in which a fuel amount corresponding to said increase is asynchronously injected with respect to rotation of the engine and is injected when the engine running state is at a predetermined acceleration condition during the engine intake stroke.

12. The engine air-fuel ratio controller as defined in claim 11, wherein the asynchronous injection is performed when it is sensed that a difference between the basic fuel injection amount $T_{pm-1}$ at an immediately preceding synchronous injection time and the basic injection amount $t_{pm}$ at a current synchronous injection time is a positive value that is greater than a threshold value LASNI.

* * * * *